US010213822B2

(12) United States Patent
Lee et al.

(10) Patent No.: US 10,213,822 B2
(45) Date of Patent: Feb. 26, 2019

(54) FEEDSTOCK BARRELS COATED WITH INSULATING FILMS FOR RAPID DISCHARGE FORMING OF METALLIC GLASSES

(71) Applicant: Glassimetal Technology, Inc., Pasadena, CA (US)

(72) Inventors: David S. Lee, Wenham, MA (US); Joseph P. Schramm, Sierra Madre, CA (US); Marios D. Demetriou, West Hollywood, CA (US); William L. Johnson, San Marino, CA (US)

(73) Assignees: Glassimetal Technology, Inc., Pasadena, CA (US); Apple Inc., Cupertino, CA (US)

( * ) Notice: Subject to any disclaimer, the term of this patent is extended or adjusted under 35 U.S.C. 154(b) by 115 days.

(21) Appl. No.: 14/501,707

(22) Filed: Sep. 30, 2014

(65) Prior Publication Data

US 2015/0096967 A1 Apr. 9, 2015

Related U.S. Application Data

(60) Provisional application No. 61/886,477, filed on Oct. 3, 2013.

(51) Int. Cl.

| | |
|---|---|
| ***B21J 1/06*** | (2006.01) |
| ***B21J 1/00*** | (2006.01) |
| ***B22D 17/20*** | (2006.01) |
| *C21D 1/40* | (2006.01) |

(52) U.S. Cl.

CPC ..... *B21J 1/06* (2013.01); *B21J 1/006* (2013.01); *B22D 17/2023* (2013.01); *C21D 1/40* (2013.01)

(58) Field of Classification Search

CPC ..... C03B 9/447; C03B 23/03; C03B 23/02
USPC ..... 219/149, 154
See application file for complete search history.

(56) References Cited

U.S. PATENT DOCUMENTS

| | | | |
|---|---|---|---|
| 2,467,782 | A | 12/1947 | Schuman |
| 2,816,034 | A | 12/1957 | Mittelmann |
| 3,332,747 | A | 7/1967 | Bundy |
| 3,537,045 | A | 10/1970 | Ichiro |
| 3,863,700 | A | 2/1975 | Bedell et al. |
| 4,115,682 | A | 9/1978 | Kavesh et al. |
| 4,355,221 | A | 10/1982 | Lin |

(Continued)

FOREIGN PATENT DOCUMENTS

| | | |
|---|---|---|
| CN | 1552940 | 12/2004 |
| CN | 1689733 | 11/2005 |

(Continued)

OTHER PUBLICATIONS

De Oliveira et al., "Electromechanical engraving and writing on bulk metallic glasses", Applied Physics Letters, Aug. 26, 2002, vol. 81, No. 9, pp. 1606-1608.

(Continued)

*Primary Examiner* — Dana Ross
*Assistant Examiner* — Ayub Maye
(74) *Attorney, Agent, or Firm* — Polsinelli PC

(57) ABSTRACT

The present disclosure is directed to feedstock barrels comprising thermally and electrically insulating films configured to be adjacent to a feedstock sample when it is loaded in the barrel for the process of shaping metallic glasses by rapid capacitor discharge forming (RCDF) techniques.

20 Claims, 4 Drawing Sheets

(56) References Cited

U.S. PATENT DOCUMENTS

| | | | | |
|---|---|---|---|---|
| 4,462,092 | A | 7/1984 | Kawabuchi et al. | |
| 4,523,748 | A | 6/1985 | Latter | |
| 4,571,414 | A | 2/1986 | Renlund et al. | |
| 4,715,906 | A | 12/1987 | Taub et al. | |
| 4,809,411 | A | 3/1989 | Lin et al. | |
| 4,950,337 | A | 8/1990 | Li et al. | |
| 5,005,456 | A | 4/1991 | Ballard et al. | |
| 5,069,428 | A | 12/1991 | Li et al. | |
| 5,075,051 | A | 12/1991 | Ito et al. | |
| 5,278,377 | A | 1/1994 | Tsai | |
| 5,288,344 | A | 2/1994 | Peker et al. | |
| 5,324,368 | A | 6/1994 | Masumoto et al. | |
| 5,368,659 | A | 11/1994 | Peker et al. | |
| 5,550,857 | A | 8/1996 | Richards | |
| 5,554,838 | A | 9/1996 | Berdich | |
| 5,618,359 | A | 4/1997 | Lin et al. | |
| 5,735,975 | A | 4/1998 | Lin et al. | |
| 5,896,642 | A | 4/1999 | Peker et al. | |
| 6,027,586 | A | 2/2000 | Masumoto et al. | |
| 6,235,381 | B1 | 5/2001 | Sanders et al. | |
| 6,258,183 | B1 | 7/2001 | Onuki et al. | |
| 6,279,346 | B1 * | 8/2001 | Ribes | C03B 9/447 264/334 |
| 6,293,155 | B1 | 9/2001 | Babiel | |
| 6,355,361 | B1 | 3/2002 | Ueno et al. | |
| 6,432,350 | B1 | 9/2002 | Seres et al. | |
| 6,771,490 | B2 | 8/2004 | Peker et al. | |
| 6,875,293 | B2 | 4/2005 | Peker | |
| 7,120,185 | B1 | 10/2006 | Richards | |
| 7,506,566 | B2 | 3/2009 | Decristofaro et al. | |
| 7,883,592 | B2 | 2/2011 | Hofmann et al. | |
| 8,099,982 | B2 * | 1/2012 | Takagi | C03B 11/082 264/449 |
| 8,276,426 | B2 | 10/2012 | Musat et al. | |
| 8,499,598 | B2 | 8/2013 | Johnson et al. | |
| 8,613,813 | B2 | 12/2013 | Johnson et al. | |
| 8,613,814 | B2 | 12/2013 | Kaltenboeck et al. | |
| 8,613,815 | B2 | 12/2013 | Johnson et al. | |
| 8,613,816 | B2 | 12/2013 | Kaltenboeck et al. | |
| 8,776,566 | B2 | 7/2014 | Johnson et al. | |
| 2001/0033304 | A1 | 10/2001 | Ishinaga et al. | |
| 2002/0122985 | A1 | 9/2002 | Sato et al. | |
| 2003/0056562 | A1 | 3/2003 | Kamano | |
| 2003/0183310 | A1 | 10/2003 | McRae | |
| 2003/0222122 | A1 | 12/2003 | Johnson et al. | |
| 2004/0035502 | A1 | 2/2004 | Kang et al. | |
| 2004/0067369 | A1 * | 4/2004 | Ott | C03B 5/1672 428/432 |
| 2005/0034787 | A1 | 2/2005 | Song et al. | |
| 2005/0103271 | A1 | 5/2005 | Watanabe et al. | |
| 2005/0202656 | A1 | 9/2005 | Ito et al. | |
| 2005/0217333 | A1 | 10/2005 | Daehn | |
| 2005/0236071 | A1 | 10/2005 | Koshiba et al. | |
| 2006/0102315 | A1 | 5/2006 | Lee et al. | |
| 2006/0293162 | A1 | 12/2006 | Ellison | |
| 2007/0003782 | A1 | 1/2007 | Collier | |
| 2007/0023401 | A1 | 2/2007 | Tsukamoto et al. | |
| 2007/0034304 | A1 | 2/2007 | Inoue et al. | |
| 2008/0081213 | A1 | 4/2008 | Ito et al. | |
| 2008/0135138 | A1 | 6/2008 | Duan et al. | |
| 2008/0302775 | A1 | 12/2008 | Machrowicz | |
| 2009/0236017 | A1 | 9/2009 | Johnson et al. | |
| 2009/0246070 | A1 | 10/2009 | Tokuda et al. | |
| 2010/0009212 | A1 | 1/2010 | Utsunomiya et al. | |
| 2010/0047376 | A1 | 2/2010 | Imbeau et al. | |
| 2010/0121471 | A1 | 5/2010 | Higo et al. | |
| 2010/0320195 | A1 | 12/2010 | Fujita et al. | |
| 2011/0048587 | A1 | 3/2011 | Vecchio et al. | |
| 2012/0103478 | A1 | 5/2012 | Johnson et al. | |
| 2013/0025814 | A1 | 1/2013 | Demetriou et al. | |
| 2013/0048152 | A1 | 2/2013 | Na et al. | |
| 2013/0319062 | A1 | 12/2013 | Johnson et al. | |
| 2014/0033787 | A1 | 2/2014 | Johnson et al. | |
| 2014/0047888 | A1 | 2/2014 | Johnson et al. | |
| 2014/0083150 | A1 | 3/2014 | Kaltenboeck et al. | |
| 2014/0102163 | A1 | 4/2014 | Kaltenboeck et al. | |
| 2014/0130563 | A1 | 5/2014 | Lee et al. | |
| 2014/0283956 | A1 | 9/2014 | Schramm et al. | |
| 2015/0090375 | A1 | 4/2015 | Lee et al. | |
| 2015/0096967 | A1 | 4/2015 | Lee et al. | |
| 2015/0231675 | A1 | 8/2015 | Johnson et al. | |
| 2015/0367410 | A1 | 12/2015 | Schramm et al. | |
| 2016/0298205 | A1 | 10/2016 | Johnson et al. | |
| 2018/0065173 | A1 | 3/2018 | Crewdson et al. | |

FOREIGN PATENT DOCUMENTS

| | | |
|---|---|---|
| CN | 201838352 | 5/2011 |
| CN | 103320783 | 9/2013 |
| FR | 2806019 | 9/2001 |
| GB | 215522 | 5/1924 |
| GB | 2148751 | 6/1985 |
| JP | 48-008694 | 3/1973 |
| JP | 63-220950 | 9/1988 |
| JP | H06-57309 | 3/1994 |
| JP | H06-277820 | 10/1994 |
| JP | H 08-024969 | 1/1996 |
| JP | 08-300126 | 11/1996 |
| JP | 10-263739 | 10/1998 |
| JP | 10-296424 | 11/1998 |
| JP | 11-001729 | 1/1999 |
| JP | 11-104810 | 4/1999 |
| JP | 11-123520 | 11/1999 |
| JP | 11-354319 | 12/1999 |
| JP | 2000-119826 | 4/2000 |
| JP | 2000-169947 | 6/2000 |
| JP | 2001-321847 | 11/2001 |
| JP | 2001-347355 | 12/2001 |
| JP | 2003-509221 | 3/2003 |
| JP | 2005-209592 | 8/2005 |
| JP | 2008-000783 | 1/2008 |
| JP | 2011-517623 | 6/2011 |
| JP | 2013-530045 | 7/2013 |
| KR | 10-0271356 | 11/2000 |
| WO | WO 01/21343 | 3/2001 |
| WO | WO 2009/048865 | 4/2009 |
| WO | WO 09/117735 | 9/2009 |
| WO | WO 11/127414 | 10/2011 |
| WO | WO 12/051443 | 4/2012 |
| WO | WO 12/092208 | 7/2012 |
| WO | WO 12/103552 | 8/2012 |
| WO | WO 12/112656 | 8/2012 |
| WO | WO 2014/078697 | 5/2014 |

OTHER PUBLICATIONS

Duan et al., "Bulk Metallic Glass with Benchmark Thermoplastic Processability", Adv. Mater., 2007, vol. 19, pp. 4272-4275.

Ehrt et al., "Electrical conductivity and viscosity of borosilicate glasses and melts," Phys. Chem. Glasses: Eur. J. Glass Sci. Technol. B, Jun. 2009, 50(3), pp. 165-171.

Love, "Temperature dependence of electrical conductivity and the probability density function," J. Phys. C: Solid State Phys., 16, 1983, pp. 5985-5993.

Mattern et al., "Structural behavior and glass transition of bulk metallic glasses," Journal of Non-Crystalline Solids, 345&346, 2004, pp. 758-761.

Wiest et al., "Zi-Ti-based Be-bearing glasses optimized for high thermal stability and thermoplastic formability", Acta Materialia, 2008, vol. 56, pp. 2625-2630.

Yavari et al., "Electromechanical shaping, assembly and engraving of bulk metallic glasses", Materials Science and Engineering A, 2004, vol. 375-377, pp. 227-234.

Yavari et al., "Shaping of Bulk Metallic Glasses by Simultaneous Application of Electrical Current and Low Stress", Mat. Res. Soc. Symp. Proc., 2001, vol. 644, pp. L12.20.1-L12.20.6.

Demetriou, Document cited and published during Applicant Interview Summary conducted on Jan. 29, 2013, entitled, "Rapid Discharge Heating & Forming of Metallic Glasses: Concepts, Principles, and Capabilities," Marios Demetriou, 20 pages.

(56) References Cited

OTHER PUBLICATIONS

Johnson et al., "A Universal Criterion for Plastic Yielding of Metallic Glasses with a $(T/T_g)^{2/3}$ Temperature Dependence," *Physical Review Letter*, (2005), PRL 95, pp. 195501-195501-4.
Kulik et al., "Effect of flash- and furnace annealing on the magnetic and mechanical properties of metallic glasses," *Materials Science and Engineering*, A133 (1991), pp. 232-235.

* cited by examiner

FEEDSTOCK BARRELS COATED WITH INSULATING FILMS FOR RAPID DISCHARGE FORMING OF METALLIC GLASSES

CROSS-REFERENCE TO RELATED APPLICATIONS

The present application claims the benefit under 35 U.S.C. § 119(e) of U.S. Provisional Patent Application No. 61/886,477 entitled "Feedstock Barrel Rapid Discharge Forming of Metallic Glasses Comprising Tough Substrates Coated with Insulating Films", filed on Oct. 3, 2013, which is incorporated herein by reference in its entirety.

FIELD OF THE DISCLOSURE

The present disclosure relates to feedstock barrels coated with thermally and electrically insulating films. The barrels can be used for injection molding of metallic glasses by rapid capacitor discharge forming (RCDF) techniques.

BACKGROUND

U.S. Pat. No. 8,613,813 is directed, in certain aspects, to a method of rapidly heating and shaping a metallic glass using a rapid discharge of electrical current, where a quantum of electrical energy is discharged through a substantially defect-free metallic glass sample having a substantially uniform cross-section to rapidly heat the sample to a processing temperature between the glass transition temperature of the metallic glass and the equilibrium melting temperature of the metallic glass forming alloy, and then applying a deformational force to shape the heated sample into an article, and then cooling said sample to form a metallic glass article.

U.S. Patent Publication No. 2013/0025814 is directed, in certain aspects, to a method and apparatus of injection molding metallic glass articles using the RCDF method, including the disclosure of an insulating feedstock barrel, or "barrel," that is used to electrically insulate and mechanically confine the heated feedstock. Each of the foregoing patent publications is incorporated herein by reference in its entirety.

In RCDF processing, feedstock barrels capable of withstanding multiple RCDF cycles have been considered. Generally, toughened ceramics have been used for substrates for the feedstock barrels. Ceramics are electrically insulating and chemically stable up to high temperatures, and can exhibit substantial toughness. However, ceramics are generally relatively expensive materials, and the various processes used to toughen them are complex, labor intensive, and add significantly to the overall cost. Machining of ceramics is generally hard, time intensive, and requires expensive tooling. Therefore, even if an extended tool life is achieved with toughened ceramics, enabling multiple RCDF cycles, owing to the high overall cost, the cost per RCDF cycle of ceramic barrels can still be prohibitively high for many applications.

There remains a need for alternative barrels for RCDF applications that are electrically insulating and have damage tolerance to withstand at least one RCDF cycle. Problems associated with the performance of feedstock barrels in RCDF methods can be overcome by decoupling the thermal and electrical criteria from the mechanical criteria. This can be accomplished by using barrel substrates that are mechanically resilient, while disposing an insulating film on an interior surface of the barrel substrates that contacts the feedstock.

SUMMARY

The disclosure is directed to a feedstock barrel, for use in an RCDF method of forming a metallic glass article. In some embodiments, a RCDF apparatus for shaping metallic glasses includes a feedstock barrel comprising a barrel substrate and an insulating film disposed on an interior surface of the barrel substrate configured to be adjacent to a feedstock sample when the feedstock is loaded in the barrel.

In some embodiments, the RCDF apparatus may include a source of electrical energy configured to heat a metallic glass feedstock sample. The source of electrical energy can be electrically connected to at least one of a pair electrodes disposed at opposite ends of the feedstock barrel. The electrodes can be configured to discharge electrical energy sufficient to heat the feedstock sample uniformly when the feedstock sample is loaded in the feedstock barrel. Further, the RCDF apparatus may include a shaping tool disposed in forming relation to the feedstock. The shaping tool can be configured to apply a deformation force sufficient to shape the feedstock sample, when heated, in to an article. In some embodiments, the shaping tool can be configured to cool the article at a rate sufficient to avoid crystallization.

In various embodiments, the feedstock barrel substrate can demonstrate plane-strain fracture toughness of at least 30 MPa $m^{1/2}$ and yield strength of at least 30 MPa. In various embodiments, the insulating film can have a thickness t equal to or less than 5% of the substrate thickness. In some embodiments, the insulating film may have a thickness t equal to or less than 500 μm.

In various embodiments, the insulating film can have an electrical resistivity of at least $1\times10^5$ μΩ-cm. In other embodiments, the insulating film may have an electrical resistivity at least $10^3$ higher than the electrical resistivity of the metallic glass feedstock sample. In additional embodiments, the insulating film can have a "dielectric breakdown voltage" greater than 1000 V. In other embodiments, the film may have a dielectric strength of at least 5 kV/mm.

In further embodiments, the insulating film can have a "thermal relaxation time" of less than 0.1 s. In yet other embodiments, the film can have a thermal diffusivity of less than 0.1 mm/s. In various embodiments, the insulating film can have mechanical, thermal, and chemical stability such that catastrophic failure is prevented during the RCDF cycle.

In another embodiment, the barrel substrate comprises a metal.

In yet another embodiment, the barrel substrate comprises a metal selected from the group consisting of low-carbon steels, stainless steels, nickel alloys, titanium alloys, aluminum alloys, copper alloys, brasses and bronzes, and pure metals such as nickel, aluminum, copper, and titanium.

In another embodiment, the insulating film comprises a polymer.

In another embodiment, the insulating film comprises a cellulosic material.

In another embodiment, the insulating film comprises a ceramic.

In yet another embodiment, the barrel substrate comprises a material selected from the group consisting of polytetrafluroethylene, phenolic resin, high-density polyethylene, low-density polyethylene, Kapton polyimide film, red insulating varnish, and paper.

In yet another embodiment, the insulating film is free standing and adhered to the interior surface of the barrel substrate by an adhesive.

In yet another embodiment, the insulating film is deposited on to the interior surface of the barrel substrate by wet spray coating.

In yet another embodiment, the insulating film is deposited on the interior surface of the barrel substrate by powder deposition.

In yet another embodiment, the insulating film is deposited on the interior surface of the barrel substrate by chemical vapor deposition.

In still another embodiment, the insulating film is deposited on the interior surface of the barrel substrate by physical vapor deposition.

In still other embodiments, the disclosure is directed to a method of heating and shaping a bulk metallic glass feedstock sample using RCDF. The method can include discharging electrical energy across a metallic glass feedstock sample disposed in a feedstock barrel, which comprises a barrel substrate and an insulating film, to a processing temperature to heat the feedstock sample. The insulating film is disposed on an interior surface of the barrel substrate, configured to be adjacent to the metallic glass feedstock sample. The processing temperature can be between the Tg of the metallic glass and the Tm of the metallic glass forming alloy. The RCDF method can further include applying a deformational force to shape the heated feedstock sample into an article and cooling the article to a temperature below the Tg. In various aspects, the insulating film of the feedstock barrel has a thermal and chemical stability such that catastrophic failure of the feedstock barrel is prevented during the RCDF method.

BRIEF DESCRIPTION OF THE DRAWINGS

The description will be more fully understood with reference to the following figures and data graphs, which are presented as various embodiments of the disclosure and should not be construed as a complete recitation of the scope of the disclosure.

DETAILED DESCRIPTION OF THE DISCLOSURE

Figure 1:
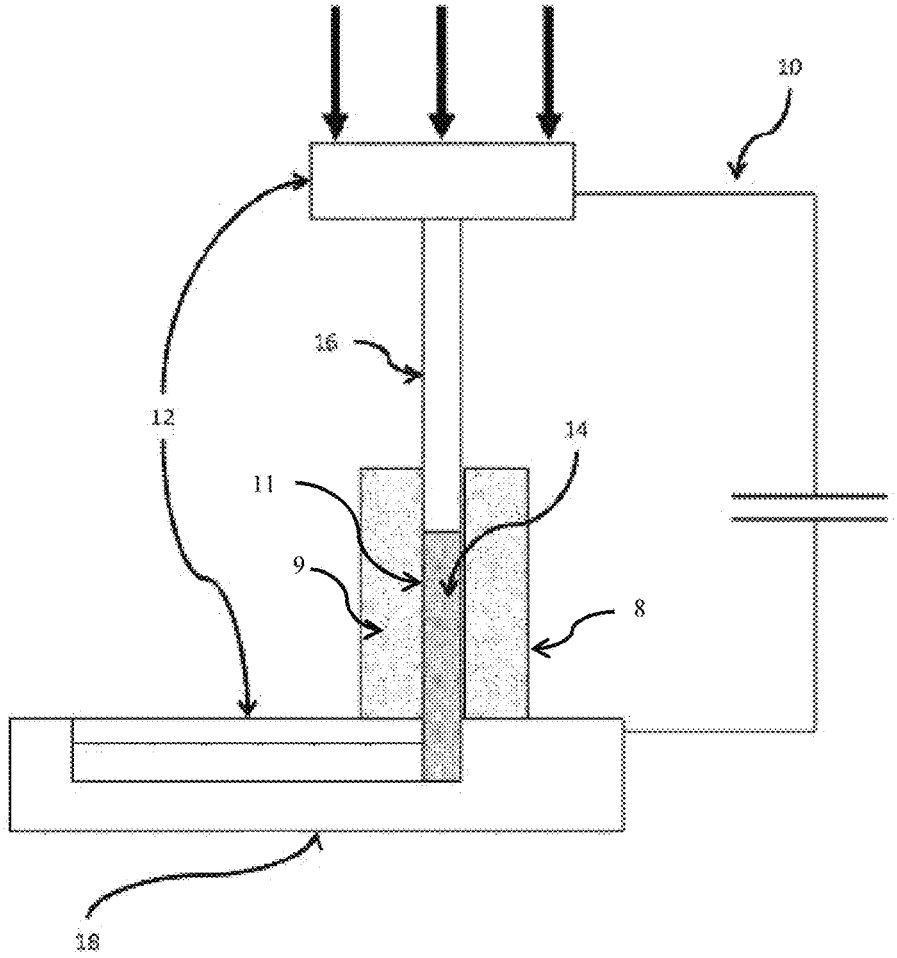
FIG. 1 shows a schematic of an exemplary embodiment of a rapid capacitor discharge forming apparatus in accordance with embodiments of the present disclosure.

The present disclosure is directed to a feedstock barrel that comprises a barrel substrate that is mechanically resilient and coated with an electrically and thermally insulating film that can be used in forming metallic glass articles using RCDF techniques. The present disclosure is also directed to methods of using the feedstock barrel in RCDF processes.

In certain aspects of the present disclosure, the terms coating, barrier coating, liner, or film refer to a thin layer of material that is either adhered, deposited, bonded or by any other means applied or attached to a surface of the barrel substrate. In other aspects, these terms refer to a thin layer of material that is disposed at the interface between the interior surface of the barrel substrate and the exterior surface of the feedstock sample when the feedstock sample is loaded in the feedstock barrel. In other aspects, these terms refer to a thin layer of material that is configured to be adjacent to the feedstock sample when the feedstock sample is loaded in the feedstock barrel.

RCDF techniques are methods of uniformly heating a metallic glass feedstock rapidly using Joule heating (e.g. heating times of less than 1 second, and in some embodiments less than 100 milliseconds), softening the metallic glass, and shaping it into a net shape article using a tool (e.g. an extrusion die or a mold). A deformational force is applied to the heated and softened feedstock to deform the heated feedstock into a desirable shape. The steps of heating and shaping are performed over a time scale shorter than the time required for the heated feedstock to crystallize. Subsequently, the deformed feedstock is allowed to cool to below the glass transition temperature. In some embodiments, the deformed feedstock is cooled to below the glass transition temperature by contact with a thermally conductive metal mold or die in order to vitrify it into an amorphous article. More specifically, the methods can utilize the discharge of electrical energy (e.g. 50 J to 100 kJ) stored in a capacitor to uniformly and rapidly heat a feedstock sample of a metallic glass to a "process temperature" conducive for viscous flow that is between the glass transition temperature $T_g$ of the metallic glass and the equilibrium melting point of the metallic glass forming alloy $T_m$ in a time scale of several milliseconds or less, and is referred to hereinafter as rapid capacitor discharge forming (RCDF).

Operating in the "injection molding" mode, the RCDF process begins with the discharge of electrical energy into a sample block of metallic glass feedstock (e.g. a rod) loaded into a feedstock barrel. In some embodiments, at least 50 J of energy is discharged. In other embodiments, at least 100 J of energy may be discharged. In yet other embodiments at least 1000 J and still in others 10000 J of energy may be discharged. In some embodiments less than 100 kJ of energy may be discharged. In other embodiments, less than 1000 J of energy may be discharged, while in other embodiments less than 100 J of energy may be discharged. In further embodiments, the amount of energy discharged may range between 50 J and 100 kJ.

The discharge of electrical energy may be used to rapidly heat the sample to a "process temperature" above the Tg of the metallic glass, and more specifically to a processing temperature between the Tg of the metallic glass and the Tm of the metallic glass forming alloy, on a time scale of several microseconds to several milliseconds or less, such that the amorphous material has a process viscosity sufficient to allow facile shaping.

In some embodiments, the process viscosity may be at least 1 Pa-s. In other embodiments, it may be at least 10 Pa-s or at least 100 Pas-s. In still other embodiments, the process viscosity may be less than 10000 Pa-s, or less than 1000 Pa-s. In yet other embodiments, the process viscosity may range from 1 to 10000 Pa-s. Meanwhile, the processing temperature may be at least 50° C. greater than the Tg in some embodiments. In other embodiments, the processing temperature may be at least 100° C. greater than the Tg. Yet, in other embodiments, the processing temperature may be less than 100° C. below Tm or less than 50° C. below Tg.

In various embodiments, the ability to shape a sample of metallic glass as described in the present disclosure depends on the ability to heat the sample in a rapid and uniform manner across the sample. If heating were not uniform, then the sample would instead experience localized heating and, although such localized heating can be useful for some techniques, such as, for example, joining or spot-welding pieces together, or shaping specific regions of the sample, such localized heating has not and cannot be used to perform bulk shaping of samples.

Likewise, if the sample heating were not sufficiently rapid (typically on the order of $500-10^5$ K/s) then either the material being formed would lose its amorphous character (i.e. it would crystallize), or the shaping technique will be limited to those amorphous materials having superior processability characteristics (i.e., high stability of the supercooled liquid against crystallization), again reducing the utility of the process. In some embodiments, using RCDF, the metallic glass can be heated at heating rates of at least $10^3$ C/s. In other embodiments, the heating rate can be of at least $10^4$ C/s. In still other embodiments, the heating rate can be at least $10^5$ C/s. In further embodiments, the heating rate may between $10^3$ C/s and $10^6$ C/s.

In the context of this disclosure, the sample being heated uniformly means that the temperature within different regions of the uniformly heated sample does not vary by more than 20%. In other embodiments, the temperature within different regions of the uniformly heated sample does not vary by more than 10%. In yet other embodiments, the temperature within different regions of the uniformly heated sample does not vary by more than 5%. In yet other embodiments, the temperature within different regions of the uniformly heated sample does not vary by more than 1%. By heating uniformly, the metallic glass may be shaped into a high quality BMG article via injection molding.

In some embodiments, the sample is evenly heated such that the temperature within different regions of the evenly heated sample does not vary by more than 20%. In other embodiments, the temperature within different regions of the evenly heated sample does not vary by more than 10%. In yet other embodiments, the temperature within different regions of the evenly heated sample does not vary by more than 5%. In yet other embodiments, the temperature within different regions of the evenly heated sample does not vary by more than 1%. By evenly heating, the metallic glass may be shaped into a high quality BMG article via injection molding. "Evenly heating" and "uniformly heating" can be used interchangeably.

A schematic of an exemplary RCDF apparatus in accordance with embodiments of the RCDF method of the present disclosure is provided in FIG. 1. As shown, the basic RCDF apparatus includes a source of electrical energy (10) and at least a pair of electrodes (12) disposed at opposing ends of a feedstock barrel (8) comprising a feedstock barrel substrate (9) and insulating film (11) that has a cavity in which a metallic glass can be loaded. The pair of electrodes is used to apply electrical energy to the metallic glass feedstock sample (14) disposed in the feedstock barrel (8). The electrical energy is used to heat the sample to the process temperature uniformly. The metallic glass feedstock sample forms a viscous liquid that can be simultaneously or consecutively shaped by injection molding in mold (18) to form an amorphous article.

In one embodiment, shown schematically in FIG. 1, an injection molding apparatus may be incorporated with the RCDF method. In such an embodiment, the viscous liquid of the heated amorphous material is injected into a mold cavity (18) using, for example, a mechanically loaded plunger to form a net shape component of the metallic glass. In some embodiments, the mold is held at room temperature, while in other embodiments the mold is held to a temperature as high as Tg.

In the example of the method illustrated in FIG. 1, the feedstock sample is located in the barrel described herein, and can be preloaded to an injection pressure (typically 1-100 MPa) by a cylindrical plunger made of a conducting material (such as copper or silver) having both high electrical conductivity and thermal conductivity. In certain embodiments, an electrode can also act as a plunger. The metallic glass sample may rest on an electrically grounded base electrode. The stored energy of a capacitor can be discharged across the metallic glass feedstock sample provided that certain criteria discussed above are met. The plunger, which in some embodiments may be pre-loaded, then drives the heated viscous melt into the mold cavity. It will be noted to those skilled in the art that the gate between the feedstock barrel (8) and mold (18) can be placed anywhere in relation to the feedstock barrel. In some embodiments, for example, the gate can be an opening disposed in a middle portion of the barrel (embodiment not shown) or in other embodiments, the gate can be disposed at an end of the barrel.

It should be understood that any source of electrical energy suitable for supplying a pulse of sufficient energy may be used. For example, a capacitor having a discharge time from 10 μs to 100 milliseconds may be used. In addition, any electrodes suitable for providing contact across the sample may be used to transmit the electrical energy.

In the certain modes of RCDF, such as the injection molding mode, the RCDF apparatus includes a feedstock barrel that is used to house the feedstock, electrically insulate it during electrical discharge from the surrounding metal tooling, and mechanically confine it once it reaches its viscous state and the deformational force is applied. In some embodiments, the feedstock barrel can be used to guide the deforming feedstock sample through an opening (i.e. sometimes referred to as a gate) in the barrel and onto a runner that leads to a mold cavity in which the softened feedstock would ultimately fill.

In general, the feedstock barrel can be electrically insulating and chemically stable at temperatures up to about 600° C., and in some embodiments up to about 800° C. The barrel can have adequate mechanical integrity up to such temperatures to sustain the stresses experienced during the RCDF injection molding process. Moreover, if the feedstock barrel is used repeatedly for multiple RCDF cycles of injection molding, cyclic mechanical and thermal performance is required for the barrel. Specifically, the material properties for a feedstock barrel used in the RCDF injection molding can include: adequate toughness to resist fracture, adequate yield strength to withstand the stresses experienced during the RCDF process, high resistivity and dielectric strength to electrically insulate the feedstock and electrodes from the surrounding tooling, and thermal and chemical stability to withstand exposure to the softened metallic glass feedstock at temperatures up to about 800° C. for the duration of the RCDF process (less than 0.5 s). A barrel that can maintain these properties under cyclic mechanical and thermal loads can be used as a permanent or semi-permanent feedstock barrel. These properties affect the choice of materials for a repeated use barrel.

Generally, barrel materials used were toughened ceramics. Examples of ceramic barrel substrate materials disclosed include Macor, yttria-stabilized zirconia, or fine-grained alumina. Ceramics are electrically insulating and chemically very stable up to high temperatures, and when properly processed they can exhibit substantial toughness and machinability. However, ceramics are generally relatively expensive materials, and the various processes used to toughen them are complex, labor intensive, and add significantly to the overall cost. Machining of ceramics is generally hard, time intensive, and requires expensive tooling. Moreover, the requirement for split-barrel design further complicates the machining process and adds to the overall cost. Therefore, even if an extended tool life is achieved with toughened ceramics enabling multiple RCDF cycles, owing to the high overall cost, the cost per RCDF cycle of ceramic barrels can still be prohibitively high for many applications.

Generally, the mechanical performance and damage tolerance of thermally and electrically insulating materials tends to be poor. For example, ceramic materials generally tend to be brittle, while plastics tend to be weak. Specifically, over a large number of RCDF cycles, ceramics tend to crack or chip while plastics tend to deform and scratch.

Problems associated with the performance of feedstock barrels in RCDF methods can be overcome by decoupling the thermal and electrical criteria from the mechanical criteria. This can be accomplished by using barrel substrates that are mechanically resilient and damage tolerant while disposing a thermally and/or electrically insulating film on the interior surface of the of the barrel substrate that contacts the feedstock. In this manner, RCDF barrels can be constructed that exhibit electrical and thermal insulating characteristics at the interface with the feedstock, and that also have the mechanical resilience and damage tolerance to withstand a large number of RCDF cycles.

Separating the bulk mechanical requirements from the electrical and thermal interfacial requirements allows for selection of a wider variety of materials in the feedstock barrel substrate instead of limiting the feedstock barrel substrate to only materials satisfying the mechanical, electrical, and thermal requirements. It allows for the use of mechanically resilient materials as barrel substrate materials, which may not be electrically insulting, such as a metal. In terms of mechanical properties (e.g. toughness and yield strength) and machinability alone, metals have improved properties compared to ceramics for use as feedstock barrel substrates. Metals are less susceptible to damage and are more readily machinable using conventional machining methods in comparison to ceramics. Metals, however, are electrically conductive, and when used directly as a feedstock barrel, can conduct electrical current giving rise to very inefficient and non-uniform heating of the feedstock sample. Moreover, metals are also highly thermally conductive, and can result in considerable cooling of the feedstock while in the contact with the feedstock barrel.

In order to use such damage tolerant materials as feedstock barrels for RCDF techniques while overcoming their potentially highly conductive properties, the barrel can be made electrically and thermally insulating by disposing an electrical and thermally insulating film on the interior surface of the barrel substrate to be configured to be adjacent to the feedstock sample when the feedstock sample is loaded in the barrel.

In various embodiments, the insulating film has a thickness sufficiently small such that mechanical support is accommodated predominantly by the stronger and tougher substrate. The film can have a high electrical resistivity and a high dielectric strength to prevent any current flow across the substrate. The film can also have a low thermal diffusivity so as to prevent any heat transport from the heated feedstock to the cold substrate. The film can further have a thermal stability such that the film does not catastrophically decompose during exposure to high temperatures.

The present disclosure is also directed to barrel substrates that have high yield strength and high fracture toughness, and to barrier coatings that are considerably thinner than the substrate. The barrier coatings or films can be thermally and electrically insulating, have a high dielectric strength, a low thermal diffusivity, and a high operating temperature.

In some embodiments, the barrel substrates can have a plane-strain fracture toughness of at least 30 MPa $m^{1/2}$ and a yield strength of at least 30 MPa. In other embodiments, the barrel substrates have a plane-strain fracture toughness of at least 60 MPa $m^{1/2}$ and a yield strength of at least 100 MPa. In various embodiments, the barrel substrates may be a metal including, but not limited to, low-carbon steels, stainless steels, nickel alloys, titanium alloys, aluminum alloys, copper alloys, brasses and bronzes, and pure metals such as nickel, aluminum, copper, and titanium. Data for the yield strengths and fracture toughness of such alloys are listed in Table 1. (Data from M. F. Ashby and D. R. H. Jones, Engineering Materials 1: An Introduction to Properties, Applications, and Design, 3rd Edition, Elsevier UK, 2005 p. 110 and 178, and from Ashby, M. F. Materials Selection in Mechanical Design. (Pergamon Press, Oxford, 1992, p. 38)). As shown in Table 1, most metals, except some aluminum alloys, meet the above criteria.

TABLE 1

Yield strength and fracture toughness data for example metal alloys.

| Material | Yield Strength (MPa) | Fracture Toughness (MPa $m^{1/2}$) |
|---|---|---|
| Low alloy steels | 500-1900 | 50-154 |
| Stainless steels | 285-500 | 50-100 |
| Nickel alloys | 70-1600 | 60-150 |
| Titanium alloys | 500-1320 | 55-115 |
| Aluminum alloys | 40-627 | 23-45 |
| Copper alloys | 60-960 | 30-100 |
| Brasses and bronzes | 70-640 | 50-100 |
| Ni, Al, Cu, Ti | 40-434 | 100-350 |

In some embodiments, the insulating film can have a cross-sectional thickness t that does not exceed 5% of the substrate cross-sectional thickness, such that the mechanical support is accommodated predominantly by the substrate. For example, in one embodiment, if the substrate cross section thickness is 1 centimeter, the film cross section thickness can be 500 micrometers or less. In other embodiments, the insulating film can have a cross-sectional thickness t that is equal to or less than 1% of the substrate cross-sectional thickness. In yet other embodiments, the insulating film can have a cross-sectional thickness t that is equal to or less than 500 micrometers. In yet other embodiments, the insulating film can have a cross-sectional thickness t that is equal to or less than 200 micrometers.

In some embodiments, the insulating films can have high electrical resistivity to electrically insulate the feedstock barrel during the current discharge, such that current is transported predominantly through the metallic glass feedstock sample. Metallic glasses have resistivity in the range of 100-200 μΩ-cm. In some embodiments, the resistivity of the insulating film can be at least $10^3$ times higher than that of the metallic glass feedstock sample. In other embodiments, the resistivity of the insulating film can be at least $10^8$ times higher than that of the metallic glass feedstock. In yet other embodiments, the insulating film can have an electrical resistivity of at least $1\times10^5$ μΩ-cm. In yet other embodiments, the insulating film can have an electrical resistivity of at least $1\times10^{10}$ μΩ-cm.

If the metallic glass feedstock sample and insulating film of the feedstock barrel were parallel resistors of equal size, an insulating film that is $10^3$ times less conducting than the feedstock sample can result in approximately 99.9% of the applied current passing through the feedstock sample. In some embodiments of the present disclosure, the electrical resistivity of the insulating film is such that 99.9% of the applied current passes through the feedstock sample. In other embodiments, the electrical resistivity of the insulating film is such that 99.999% of the applied current passes through the feedstock sample. In yet other embodiments, the electrical resistivity of the insulating film is such that essentially negligible electrical current (i.e. <10 A, and in some embodiments less than 1 A) flows across the insulating film during the RCDF cycle.

The electrical resistivities of selected materials are shown in Table 2 (data taken from www.matweb.com). As shown in Table 2, polyimide such as "Kapton", polytetrafluroethylene such as "Teflon" (by DuPont), HDPE, modified Alkyd resin varnish such as "Voltatex" (by DuPont), and paper all have an electrical resistivity greater than $1\times10^5$ μΩ-cm.

TABLE 2

Resistivity of selected materials.

| Material | Resistivity (μΩ cm) |
|---|---|
| Copper | 1.5 |
| Metallic Glass Alloys | 100-200 |
| Graphite | 750-6000 |
| Alumina | $>1\times10^{20}$ |
| Yttria-Stabilized Zirconia | $1\times10^{15}$ |
| polyimide ("Kapton") | $1.0\times10^{23}$-$1.5\times10^{23}$ |
| Polytetrafluoroethylene ("Teflon") | $1.0\times10^{20}$-$1.0\times10^{24}$ |
| High Density Polyethylene (HDPE) | $1.0\times10^{11}$-$1.0\times10^{26}$ |
| Modified Alkyd-Resin varnish ("Voltatex") | $1.0\times10^{21}$ |
| Paper | $1.0\times10^{14}$-$1.0\times10^{15}$ |

As shown in Table 2, in some embodiments, the electrical resistivity of the insulating barrier film may be at least at $1\times10^{10}$ μΩ-cm, and in still other embodiments, at least $1\times10^{15}$ μΩ-cm. In further embodiments, the electrical resistivity ranges from $1\times10^5$ μΩ-cm to $1\times10^{30}$ μΩ-cm.

The insulating film can also have dielectric strength κ sufficiently high to resist current discharge across it (i.e. from the electrically conducting feedstock sample to the substrate of the feedstock barrel), such that current is transported predominantly through the metallic glass feedstock sample. The insulating film can be able to resist current discharge under typical voltages applied in the RCDF process, which can reach values as high as 1000 V or greater. In other words, the insulating film can have a dielectric breakdown voltage greater than 1000 V. The "dielectric breakdown voltage" is defined as the product κ·t, where κ is the dielectric strength of the insulating film material and t the film thickness. Therefore, the insulating film can have a dielectric strength κ such that for a given film thickness t, the breakdown voltage is κt>1000 V. In one embodiment, if the insulating film thickness t is 100 micrometers, the film material can have a dielectric strength κ>1000 V/t, i.e. κ of at least 10 kV/mm. In another embodiment, if the film thickness t is 50 micrometers, the film can have a dielectric strength κ>1000 V/t, i.e. κ of at least 20 kV/mm. Dielectric strengths of selected materials are shown in Table 3 (data taken from www.matweb.com).

TABLE 3

Dielectric strength of selected materials.

| Material | Dielectric Strength (kV/mm) |
|---|---|
| Paper | 7 |
| Yttria-Stabilized Zirconia | 9 |
| Polytetrafluoroethylene ("Teflon") | 60 |
| High Density Polyethylene (HDPE) | 20 |
| polyimide film ("Kapton") | 154 |
| Modified Alkyd-Resin varnish (Voltatex") | 80 |
| Red Insulating Varnish | 102 |

In some embodiments, the insulating film may have a dielectric strength κ of at least 5 kV/mm. In other embodiments, the film material may have a dielectric strength κ of at least 10 kV/mm. In yet other embodiments, the insulating film may have a dielectric strength κ of at least 50 kV/mm. In some embodiments of the present disclosure, the dielectric strength and thickness of the insulating film are such that 99.9% of the applied current passes through the feedstock sample. In other embodiments, the dielectric strength and thickness of the insulating film is such that 99.999% of the applied current passes through the feedstock sample. In yet other embodiments, the dielectric strength and thickness of the insulating film is such that the current passing across the film is equal to or less than 10 A. In yet other embodiments, the dielectric strength and thickness of the insulating film is such that the current passing across the film is equal to or less than 1 A.

The insulating film can also be thermally insulating such that negligible heat transport occurs across the film (i.e. from the heated feedstock sample to the cold thermally conducting substrate), and consequently the feedstock sample maintains a uniform temperature in the supercooled liquid state prior to injection into a mold. The insulating film can have a thermal diffusivity D such that it is able to resist heat transport under the time scales associated with the heating and shaping stages in the RCDF process (e.g. as long as 0.1 s, and in some embodiments as long as 0.5 s). In one example, the insulating film material can have a thermal diffusivity D sufficiently low that for a given film thickness t, the characteristic thermal relaxation time is $t^2/D>0.1$ s. "Thermal relaxation time" is defined as the ratio $t^2/D$, where D is the thermal diffusivity of the film material and t the film thickness. If the film thickness t is, for example, 100 micrometers, the insulating film material can have a thermal diffusivity $D<t^2/0.1$ s, i.e. D of less than 0.1 $mm^2/s$. If the film thickness t is, for example, 50 micrometers, the insulating film material can have a thermal diffusivity $D<t^2/0.1$ s, i.e. D of less than 0.25 $mm^2/s$. Thermal diffusivities of selected materials are shown in Table 4 (data taken from www.matweb.com).

TABLE 4

Thermal diffusivity of selected materials.

| Material | Thermal diffusivity ($mm^2/s$) |
|---|---|
| Alumina | 12 |
| Yttria-Stabilized Zirconia | 0.94 |
| Polytetrafluoroethylene ("Teflon") | 0.120 |
| High Density Polyethylene (HDPE) | 0.197 |
| Low Density Polyethylene (LDPE) | 0.170 |
| Polyimidefilm ("Kapton") | 0.0775 |
| Paper | 0.06-0.08 |

In some embodiments, the insulating film may have a thermal diffusivity D of less than 1 $mm^2/s$. In other embodiments, the insulating film may have a thermal diffusivity D of less than 0.2 $mm^2/s$. In yet other embodiments, the insulating film may have a thermal diffusivity D of less than 0.1 $mm^2/s$. In certain embodiments of the current disclosure, the thermal diffusivity and thickness of the insulating film are such that the thermal relaxation time is greater than the time associated with heating the shaping of the feedstock sample in the RCDF process. In some embodiments, the thermal diffusivity and thickness of the insulating film are such that the thermal relaxation time is greater than 0.05 s. In other embodiments of the current disclosure, the thermal diffusivity and thickness of the insulating film are such that the thermal relaxation time is greater than 0.1 s.

In some embodiments, the insulating film can also maintain chemical stability at temperatures of up to 600° C., while in other embodiments up to 800° C., under the times associated with the current discharge in the RCDF process. In some embodiments, the current discharge time may occur in less than 0.5 s. In other embodiments, the current discharge time may be less than 0.1 s. Materials having operating temperatures as high as 600° C., or in some embodiments as high as 800° C., can meet this criterion. In addition, materials with lower operating temperatures, but which can withstand temperatures as high as 600° C., or in some embodiments as high as 800° C., for periods of less than 0.5 s, or in other embodiments for periods of less than less than 0.1 s, without suffering "catastrophic failure" can also meet this criterion. In the context of this disclosure, "catastrophic failure" of an insulating film as a result of exposure to high temperatures means chemically decomposing or losing their shape, mechanical integrity, or their ability to electrically and/or thermally insulate. The maximum service temperatures of selected materials are shown in Table 5.

TABLE 5

Maximum service temperature of selected materials.

| Material | Maximum Service Temperature (° C.) |
|---|---|
| Pyrex | 821 (softening point) |
| Fused Silica Glass | 1583-1710 (softening point) |
| Alumina | 1750 |
| Yttria-Stabilized Zirconia | 1500 |
| Paper | 90 |
| Polytetrafluroethylene ("Teflon") | 93.3-316 |
| Phenolic resin | 150-219 |
| High-Density Polyethylene (HDPE) | 70-120 |
| polyimide film ("Kapton") | 400 |
| Red insulating varnish | 200 |

In the present disclosure, the insulating film may be adhered, deposited, bonded, or by any other means applied or attached to the interior surface of the barrel substrate. In some embodiments, the insulating film may be configured to be adjacent to the feedstock sample when the feedstock sample is loaded in the feedstock barrel. In other embodiments, the insulating film may be configured to be disposed at the interface between the interior of the barrel substrate and the exterior of feedstock sample when the feedstock sample is loaded in the feedstock barrel. For example, the insulating film could be a free standing film that is adhered to the substrate by high temperature adhesives, and is replaced after being degraded following several RCDF cycles. In another example, the insulating film may be deposited on the substrate by wet-spray coating, and is re-deposited after being degraded following several RCDF cycles. In further embodiments, the barrier coating may be deposited by powder deposition, physical vapor deposition, chemical vapor deposition or any other suitable thin film deposition technique. In yet other embodiments, the barrier coating may be adhered, deposited, bonded, or by any other means applied or attached to the surface of the feedstock sample. In such embodiments, the insulating film may be applied or attached to an exterior surface of the feedstock sample. As such, the insulating film may be configured to be disposed between the feedstock sample and feedstock barrel when the feedstock sample is loaded into the feedstock barrel.

In some embodiments, the insulating film may comprise a polymer material. Without intending to be limiting, by way of example, the insulating film may comprise polytetrafluroethylene, phenolic resin, high-density polyethylene, low-density polyethylene, Kapton polyimide, or any other suitable polymer material that has the physical, electrical and thermal properties in accordance with embodiments described in the present disclosure. In other embodiments, the insulating film may comprise a cellulosic material such as paper. In yet other embodiments, the insulating film may comprise a ceramic material such as a ceramic paint or a ceramic coating.

Although the above discussion has focused on the features of certain exemplary shaping techniques, such as injection molding, it should be understood that other shaping techniques may be used with the RCDF method of the current disclosure, such as extrusion or die casting. Moreover, additional elements may be added to these techniques to improve the quality of the final article. For example, to improve the surface finish of the articles formed in accordance with any of the above shaping methods, the mold or stamp may be heated to around or just below the glass transition temperature of the metallic glass, thereby preventing surface defects. In addition, to achieve articles with better surface finish or net-shape parts, the compressive force, and in the case of an injection molding technique the compressive speed, of any of the above shaping techniques may be controlled to avoid a melt front instability arising from high "Weber number" flows, i.e., to prevent atomization, spraying, flow lines, etc.

The RCDF shaping techniques and alternative embodiments discussed above may be applied to the production of small, complex, net shape, high performance metal components such as casings for electronics, brackets, housings, fasteners, hinges, hardware, watch components, medical components, camera and optical parts, jewelry etc. The RCDF method can also be used to produce small sheets, tubing, panels, etc., which could be dynamically extruded through various types of extrusion dyes used in concert with the RCDF heating and injection system.

The methods and apparatus herein can be valuable in the fabrication of electronic devices using bulk metallic glass articles. In various embodiments, the metallic glass may be used as housings or other parts of an electronic device, such as, for example, a part of the housing or casing of the device. Devices can include any consumer electronic device, such as cell phones, desktop computers, laptop computers, and/or portable music players. The device can be a part of a display, such as a digital display, a monitor, an electronic-book reader, a portable web-browser, and a computer monitor. The device can also be an entertainment device, including a portable DVD player, DVD player, Blue-Ray disk player, video game console, music player, such as a portable music player. The device can also be a part of a device that provides control, such as controlling the streaming of images, videos, sounds, or it can be a remote control for an electronic device. The alloys can be part of a computer or its accessories, such as the hard driver tower housing or casing, laptop housing, laptop keyboard, laptop track pad, desktop keyboard, mouse, and speaker. The metallic glass can also be applied to a device such as a watch or a clock.

EXAMPLES

Without intending to be limiting, the following examples illustrate various aspects of the disclosures. It will be apparent to those skilled in the art that many modifications, both to materials and methods, may be practiced without departing from the scope of the present disclosure.

RCDF injection molding was carried out using an amorphous feedstock sample of $Ni_{68.17}Cr_{8.65}Nb_{2.98}P_{16.42}B_{3.28}Si_{0.50}$ (in atomic %) and a barrel substrate made of stainless steel with a 125 μm thick Kapton polyimide film adhered to the interior surface of the barrel substrate with 75 μm thick double-sided tape. The feedstock sample had a diameter of 4.82 mm, a length of 27.99 mm and was heated by capacitive discharge current pulse with imparted energy of 3450 J/cm$^3$ under an applied axial load of 315 lb. The current and force were applied by a 5 mm diameter copper electrode/plunger rod. The feedstock sample was supported from below by another 5 mm diameter copper stationary electrode rod. The softened feedstock was injected under the applied axial load through a 3 mm gate in the side of the barrel into a copper strip mold cavity with cross sectional dimensions of 1.5 mm×5 mm, where, after filling, it cooled to form an amorphous strip.

Figure 2:
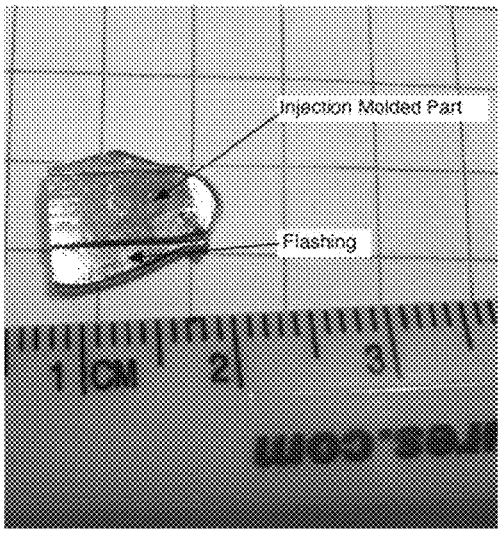
FIG. 2 shows an image of an injection molded part using the Kapton-lined steel barrel in accordance with embodiments of the present disclosure.
Figure 3A:
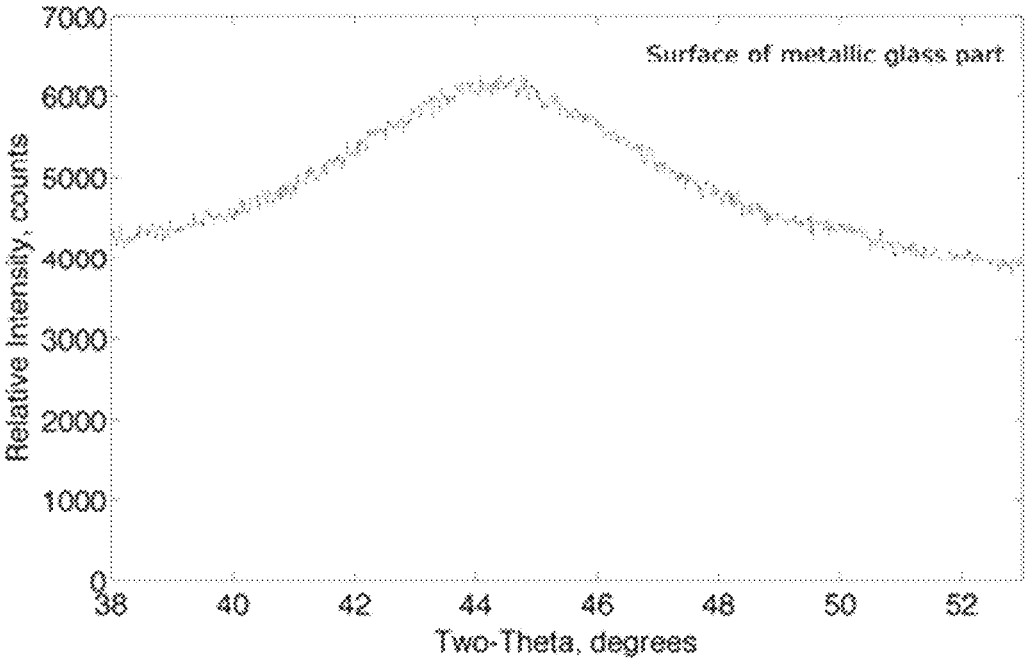
FIG. 3A shows an x-ray diffractogram verifying the amorphous nature of an injection molded part formed using a Kapton-lined stainless steel barrel in accordance with embodiments of the present disclosure.
Figure 3B:
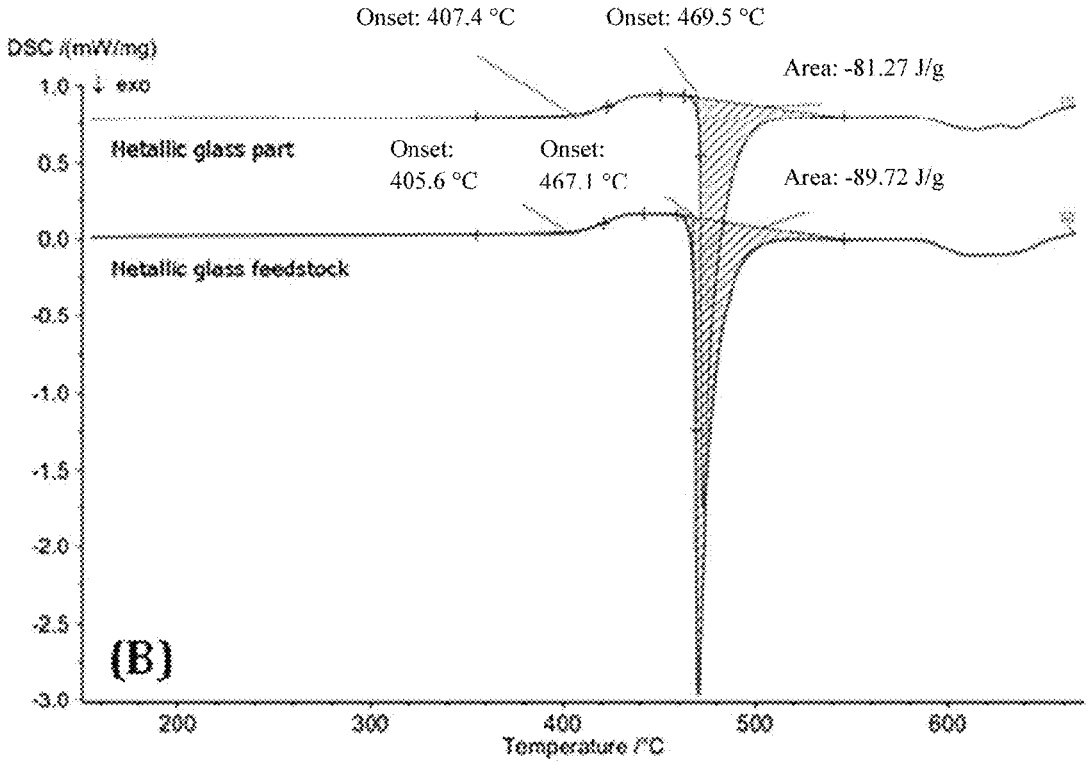
FIG. 3B shows a differential calorimetry scan verifying the amorphous nature of an injection molded part formed using a Kapton-lined stainless steel barrel in accordance with embodiments of the present disclosure. In each scan, the glass-transition temperature, crystallization temperature, and enthalpy of crystallization are indicated in order from left to right.

Photographs of an injection molding made with a Kapton-lined stainless steel barrel are shown in FIGS. 2A and 2B. The Kapton-lined steel barrel has adequately withstood the conditions encountered during the RCDF process. The feedstock has flowed into the mold cavity, and created flashing between the mold and barrel halves. The amorphous nature of the molded part made using the Kapton-lined barrel was verified by differential scanning calorimetry (DSC) and X-ray diffraction (XRD). The results of this analysis are shown in FIGS. 3A and 3B. The DSC plots suggest that the molded metallic glass strip exhibits a very similar scan to that of the fully amorphous feedstock, while no crystallographic peaks can be detected in the XRD scan.

Having described several embodiments, it will be recognized by those skilled in the art that various modifications, alternative constructions, and equivalents may be used without departing from the spirit of the disclosure. Additionally, a number of well-known processes and elements have not been described in order to avoid unnecessarily obscuring the embodiments disclosed herein. Accordingly, the above description should not be taken as limiting the scope of the document.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A rapid capacitor discharge forming (RCDF) apparatus for shaping metallic glasses, the apparatus comprising:

a feedstock barrel that comprises a feedstock barrel substrate and an insulating film disposed on the interior of the feedstock barrel substrate, wherein the feedstock barrel is configured to contain a metallic glass feedstock sample on the interior of the insulating film, wherein the feedstock barrel substrate comprises a metal;

a source of electrical energy configured to heat the metallic glass feedstock sample, said source electrically connected to at least one of a pair electrodes disposed at opposite ends of the feedstock barrel, said electrodes configured to discharge electrical energy sufficient to heat the metallic glass feedstock sample uniformly when the metallic glass feedstock sample is loaded into the feedstock barrel; and a shaping tool disposed in forming relation to the metallic glass feedstock sample, the shaping tool configured to apply a deformation force sufficient to shape the metallic glass feedstock sample when heated to an article.

2. The RCDF apparatus of claim 1, wherein the shaping tool is configured to cool the article at a rate sufficient to avoid crystallization.

3. The RCDF apparatus according to claim 1, wherein the insulating film has an electrical resistivity of at least $1\times10^5$ μΩ-cm.

4. The RCDF apparatus according to claim 1, wherein the insulating film has a dielectric strength of at least 5 kV/mm.

5. The RCDF apparatus according to claim 1, wherein the insulating film has a dielectric breakdown voltage greater than 1000 V.

6. The RCDF apparatus according to claim 1, wherein the insulating film has a thermal diffusivity less than 0.1 mm/s.

7. The RCDF apparatus according to claim 1, wherein the insulating film has a thermal relaxation time of more than 0.05 s.

8. The RCDF apparatus according to claim 1, wherein the insulating film has a thickness t equal to or less than 5% of the substrate thickness.

9. The RCDF apparatus according to claim 1, wherein the insulating film has a thickness t equal to or less than 500 micrometers.

10. The RCDF apparatus according to claim 1, wherein the insulating film comprises a material selected from the group consisting of a polymer, a cellulosic material, and a ceramic.

11. The RCDF apparatus according to claim 1, wherein the electrically insulating film is adhered to the surface of the substrate by an adhesive.

12. The RCDF apparatus according to claim 1, wherein the barrel substrate has a plane-strain fracture toughness of at least 30 MPa m$^{1/2}$.

13. The RCDF apparatus according to claim 1, wherein the barrel substrate has a yield strength of at least 30 MPa.

14. The RCDF apparatus according to claim 1, wherein the barrel substrate comprises a material selected from the group consisting of low-carbon steels, stainless steels, nickel alloys, titanium alloys, aluminum alloys, copper alloys, brasses and bronzes, and pure metals such as nickel, aluminum, copper, and titanium.

15. The apparatus of claim 1, wherein the insulating film has a thermal relaxation time $t^2/D>0.1$ s.

16. The RCDF apparatus according to claim 3, wherein the insulating film has an electrical resistivity at least $10^3$ times higher than the electrical resistivity of the metallic glass feedstock sample.

17. The RCDF apparatus according to claim 10, wherein the insulating film comprises a material selected from the group consisting of polytetrafluroethylene, phenolic resin, high-density polyethylene, low-density polyethylene, Kapton polyimide film, red insulating varnish, and paper.

18. A method of heating and shaping a metallic glass feedstock sample using an RCDF cycle comprising:

discharging electrical energy from a source of electrical energy across the metallic glass feedstock sample disposed in a feedstock barrel that comprises a feedstock barrel substrate and an insulating film, wherein the feedstock barrel substrate comprises a metal, wherein the insulating film is disposed on an interior surface of the feedstock barrel substrate, and the metallic glass feedstock sample is disposed on the interior of the insulating film of the feedstock barrel, to heat the metallic glass feedstock sample to a processing temperature between the Tg of the metallic glass and Tm of the metallic glass forming alloy, wherein the source of electrical enemy is electrically connected to at least one pair of electrodes, and wherein the at least one pair of electrodes are disposed at opposite ends of the feedstock barrel and connected to the metallic glass feedstock sample;

applying a deformational force to shape the heated metallic glass feedstock sample into an article; and cooling the article to a temperature below the Tg of the metallic glass.

19. The method according to claim 18, wherein the insulating film has thermal and chemical stability such that catastrophic failure is prevented during the RCDF cycle.

20. The method according to claim 19, wherein the insulating film has electrical resistivity and dielectric strength such that negligible electrical current flows across the insulating film during the RCDF cycle.

* * * * *